US008814322B2

(12) United States Patent
Saikawa

(10) Patent No.: US 8,814,322 B2
(45) Date of Patent: Aug. 26, 2014

(54) INKJET RECORDING APPARATUS

(75) Inventor: Akihisa Saikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 411 days.

(21) Appl. No.: 12/625,991

(22) Filed: Nov. 25, 2009

(65) Prior Publication Data

US 2010/0134548 A1 Jun. 3, 2010

(30) Foreign Application Priority Data

Nov. 28, 2008 (JP) ..... 2008-304602
Oct. 27, 2009 (JP) ..... 2009-246668

(51) Int. Cl.
*B41J 2/165* (2006.01)

(52) U.S. Cl.
USPC ..... 347/30; 347/23; 347/29

(58) Field of Classification Search
None
See application file for complete search history.

(56) References Cited

U.S. PATENT DOCUMENTS 5,248,999 A * 9/1993 Mochizuki et al. ..... 347/23
7,404,614 B2 * 7/2008 Usuda ..... 347/23
2004/0218001 A1 * 11/2004 Takahashi et al. ..... 347/30
2005/0243122 A1 11/2005 Usuda

FOREIGN PATENT DOCUMENTS

JP 2005-313114 11/2005

* cited by examiner

*Primary Examiner* — Michelle R. Connelly
*Assistant Examiner* — Chad Smith
(74) *Attorney, Agent, or Firm* — Canon USA Inc. IP Division

(57) ABSTRACT

An inkjet recording apparatus includes a recording head that includes a discharge port face on which a plurality of discharge ports for discharging ink is formed, a cap configured to cap the discharge port face, a suction recovery unit configured to suck ink from the recording head via the cap, and a control unit configured to control the suction recovery unit so that a suction amount changes based on elapsed time from when the discharge port face is capped by the cap, in a state where ink discharged from the recording head is present, wherein the control unit controls the suction recovery unit so that the suction amount decreases as the elapsed time increases when the elapsed times does not exceed a first time.

8 Claims, 16 Drawing Sheets

START
S100
GENERATE NOZZLE CHECK PATTERN
S101
DISCHARGE FAILURE DETECTED ?
S102
No
Yes
END
S119
PRELIMINARY DISCHARGE IN CAP
S103
CLOSE CAP
S104
ACQUIRE CAP CLOSING START TIME
S105
LEAVE CAP
S106
RECEIVE PRINT COMMAND
S107
ACQUIRE TIME AND CALCULATE CAP CLOSED TIME T
S108
T ≦ T1 ?
S109
T ≦ T2 ?
S111
T ≦ T3 ?
S113
T ≦ T4 ?
S115
RECOVERY SUCTION A
S110
RECOVERY SUCTION B
S112
RECOVERY SUCTION C
S114
RECOVERY SUCTION D
S116
PRINT
S117
END
S118

FIG. 6

| DISCHARGE FAILURE LEVEL | ELAPSED TIME T IN CAP CLOSED STATE | | | | |
|---|---|---|---|---|---|
| | $T \leqq T1$ | $T1 < T \leqq T2$ | $T2 < T \leqq T3$ | $T3 < T \leqq T4$ | $T4 < T$ |
| LEVEL A | RECOVERY SUCTION A | RECOVERY SUCTION B | RECOVERY SUCTION C | — | RECOVERY SUCTION D |
| LEVEL B | RECOVERY SUCTION B | RECOVERY SUCTION C | — | — | RECOVERY SUCTION D |
| LEVEL C | RECOVERY SUCTION C | — | — | — | RECOVERY SUCTION D |
| LEVEL D | — | — | — | — | RECOVERY SUCTION D |

INKJET RECORDING APPARATUS

BACKGROUND OF THE INVENTION

1. Field of the Invention

The present invention relates to an inkjet recording apparatus that includes a recording head which has a cap for capping a discharge port of the recording head.

2. Description of the Related Art

Inkjet recording apparatuses record an image by ejecting ink droplets from a fine discharge port formed on a discharge port face, which is disposed on the recording head, and causing those ink droplets to impact on a recording medium.

A problem with inkjet recording apparatuses is that viscosity increases due to evaporating of moisture in the ink from the discharge port and vicinity thereof, which is the portion where the ink contacts the air. Due to this thickened ink, discharge failure such as clogging occurs, and ink discharge becomes unstable.

A known method to counteract this problem is a recovery method in which the ink is replaced by suction and discharge of the thickened ink in the discharge port and vicinity thereof at the start of recording and at fixed time intervals. Another known method is preliminary discharge, in which the ink is discharged to a portion out of a recording area.

On the other hand, it is also known to provide a cap for capping the discharge port face of the recording head during a non-recording operation in which ink is not discharged. By providing a cap, the moisture in the ink can be prevented from evaporating from the discharge port. Further, another known method is to recover from nozzle clogging by discharging ink onto an absorber provided in the cap to keep the interior moist, and leaving the discharge port face in a moist state (e.g., Japanese Patent Application Laid-Open No. 2005-313114).

By using this method, compared with performing suction recovery, an amount of discarded ink can be substantially reduced.

In the method of recovering from clogging by discharging ink into the cap to maintain a moist state, it is necessary to keep the moist state for a long duration until the nozzle recovers from clogging.

In the method discussed in Japanese Patent Application Laid-Open No. 2005-313114, a user selects whether to perform a lengthy moistening recovery or to immediately perform suction recovery. However, when moistening recovery is selected, this document does not discuss performing a recording operation during the lengthy period that the recording head is capped.

SUMMARY OF THE INVENTION

The present invention is directed to an inkjet recording apparatus which can record without waiting for moistening recovery completion by performing suction recovery based on a moistening recovery status up until that point, and can reduce an amount of ink to be uselessly discarded, even when a recording operation command is input during the moistening recovery.

According to an aspect of the present invention, an inkjet recording apparatus includes a recording head that includes a discharge port face on which a plurality of discharge ports for discharging ink is formed, a cap configured to cap the discharge port face, a suction recovery unit configured to suck ink from the recording head via the cap, and a control unit configured to control the suction recovery unit so that a suction amount changes based on elapsed time from when the discharge port face is capped by the cap, in a state where ink discharged from the recording head is present, wherein the control unit controls the suction recovery unit so that the suction amount decreases as the elapsed time increases when the elapsed times does not exceed a first time.

According to another aspect of the present invention, an inkjet recording apparatus includes a recording head that includes a discharge port face on which a plurality of discharge ports for discharging ink is formed, a cap configured to cap the discharge port face, a suction recovery unit configured to suck ink from the recording head via the cap, and a control unit configured to control the suction recovery unit, wherein the control unit is configured to control the suction recovery unit so that a suction amount of the suction recovery unit decreases as a duration increases that the discharge port face is capped in a state where ink discharged from the recording head is present in the cap.

According to exemplary embodiments of the present invention, recording can be performed without waiting for completion of the moistening recovery by performing suction recovery based on the moistening recovery status up until that point, and the amount of wasted ink can be reduced, even when a recording operation command is input during the moistening recovery.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 6 is a table illustrating a relationship between elapsed time T in a cap closed state and recovery suction in the second exemplary embodiment.

DESCRIPTION OF THE EMBODIMENTS

Various exemplary embodiments, features, and aspects of the invention will be described in detail below with reference to the drawings.

Figure 13:
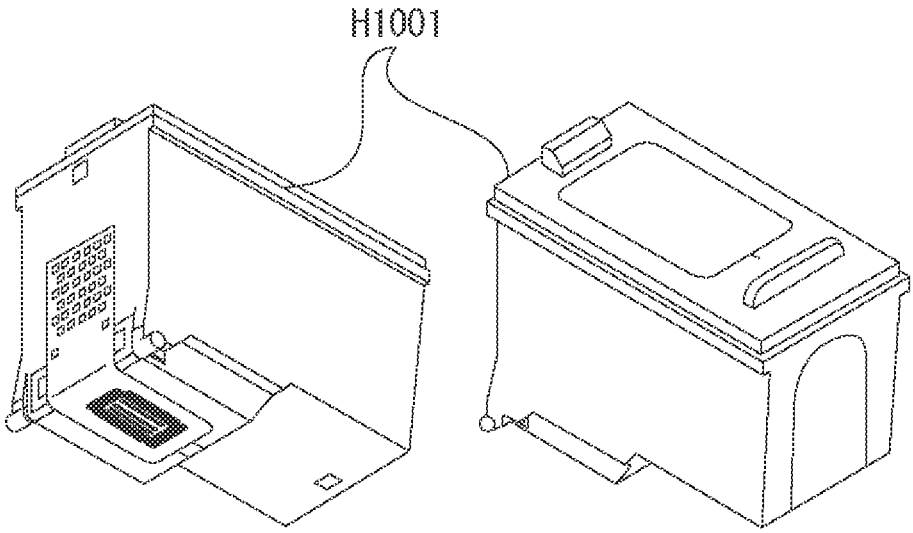
FIG. 13 illustrates a recording head.
Figure 14:
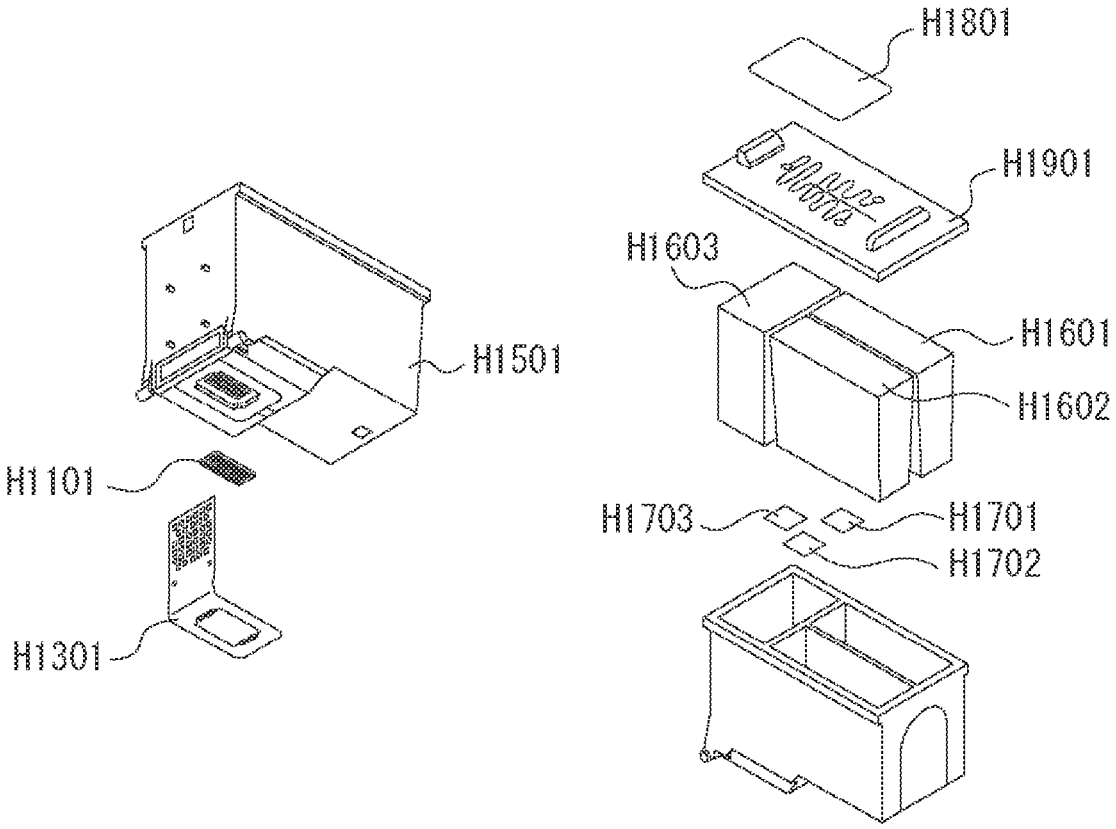
FIG. 14 is an exploded diagram of a recording head.
Figure 15:
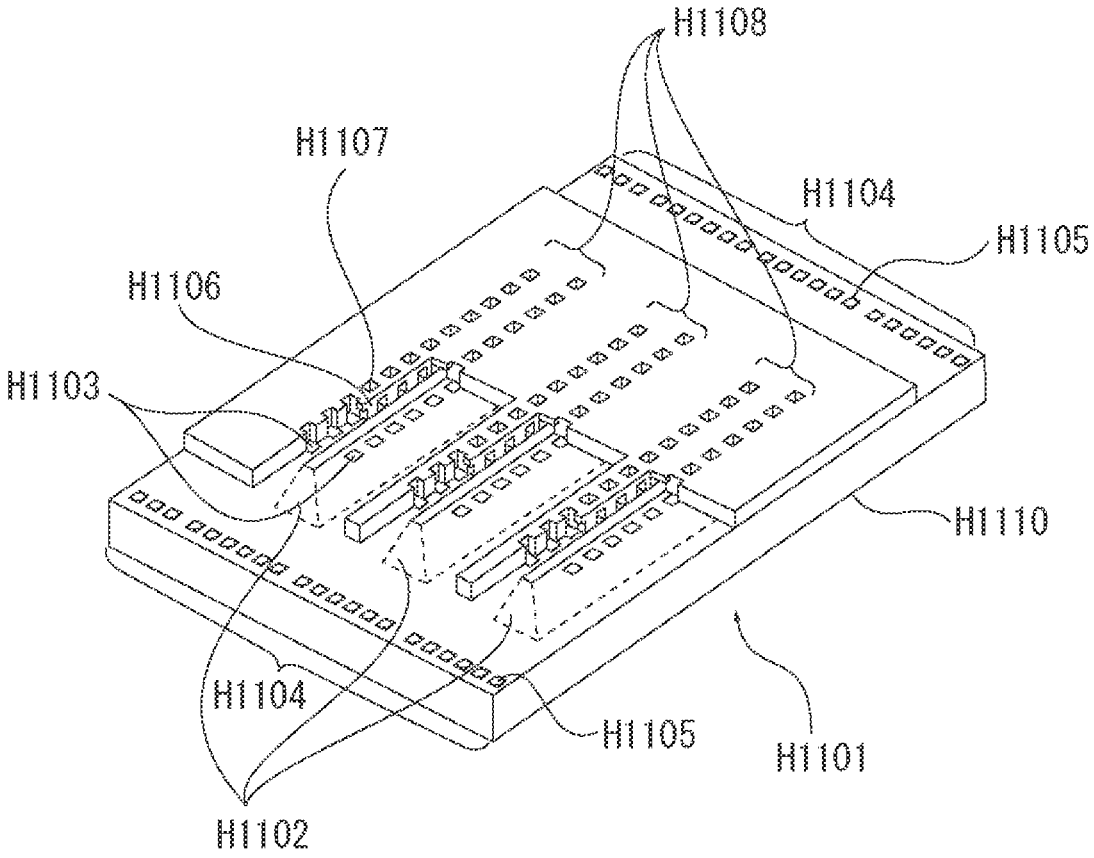
FIG. 15 is a partial cutaway perspective view of a recording element substrate.

FIGS. 13 to 15 are explanatory diagrams for illustrating a recording head according to the exemplary embodiment of the present invention. Each of the constituent elements will be described while referring to these drawings.

FIG. 13 illustrates an appearance of a recording head according to a first exemplary embodiment. The recording head is integrated with an ink tank which is mounted with a color ink (cyan ink, magenta ink, and yellow ink). A recording head H1001 is fixedly supported by a positioning device and an electrical contact point of a carriage mounted on the inkjet recording apparatus body. The recording head H1001 of each color is removably mounted on the carriage. When the mounted inks run out, it is individually replaced. The recording head according to the present invention may be mounted with respective color inks as described above, or a plurality of color inks may be mounted on a single recording head.

Next, each of the constituent elements configuring the recording head will be described using FIGS. 14 and 15. The recording head H1001 in the present exemplary embodiment is a recording head of a type using an electrothermal converter which generates thermal energy for producing film boiling in the ink based on an electric signal. Such a recording head is a "side-shooter type" in which the electrothermal converter and the ink discharge port are arranged facing each other.

The recording head H1001 is for discharging the three color inks of cyan, magenta, and yellow. As illustrated in FIG. 14, the recording head H1001 is configured from a recording element substrate H1101, an electric wiring tape H1301, an ink supply/storage member H1501, filters H1701 to H1703, ink absorbers H1601 to H1603, a lid member H1901, and a seal member H1801.

FIG. 15 is a partial cutaway perspective view illustrating a configuration of the recording element substrate H1101, which uses a silicon substrate. On the recording element substrate H1101, three ink supply ports H1102 for cyan, magenta, and yellow are arranged in parallel. The electrothermal converters H1103 and discharge ports H1107 are arranged in a line in a staggered manner on both sides of the ink supply ports H1102.

An electrode part H1104, such as electric wiring, a fuse, or a resistor, is formed on the recording element substrate H1101. On the electrode part H1104, an ink flow path wall H1106 and the discharge ports H1107 are formed from a resin material by a photolithography. A bump H1105 made of gold or the like is formed on the electrode part H1104 for supplying power to the electric wiring.

Figure 10:
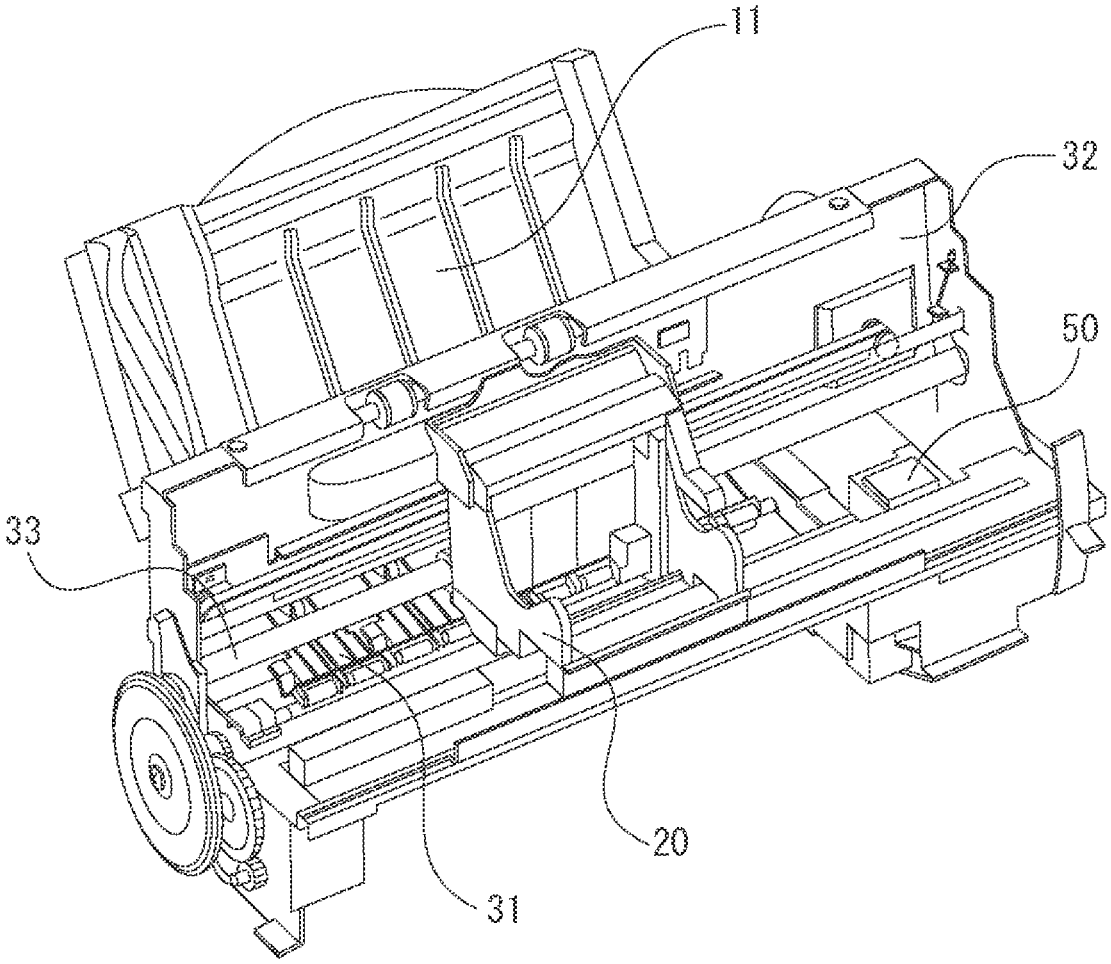
FIG. 10 illustrates an inkjet recording apparatus.

FIG. 10 is a general perspective view illustrating an overall configuration of an inkjet recording apparatus according to the exemplary embodiment of the present invention. In FIG. 10, the inkjet recording apparatus is illustrated with its upper case, which serves as an exterior of the apparatus, removed.

In FIG. 10, a sheet (medium on which recording will be performed) set in a paper feed tray 11 is fed by rotation of a feeding roller (not illustrated). The fed sheet is conveyed onto a platen 31 by a conveyance roller (not illustrated). During the conveyance, the recording head H1001 mounted on a carriage 20 discharges ink and records (forms) an image or the like on the sheet along with scanning.

Further, in FIG. 10, the recording head H1001 is removably mounted on the carriage 20. The carriage 20 slidably engages with a scanning rail 33 and a drive force from a carriage motor (not illustrated) is transmitted to the carriage 20 via a transmission mechanism such as a belt. Thus the carriage 20 can cause the recording head H1001 to perform scanning. A recovery system 50 is provided at one end of a movement range of the carriage 20 for performing discharge/recovery processing to properly maintain a discharge function of the recording head H1001.

Figure 11:
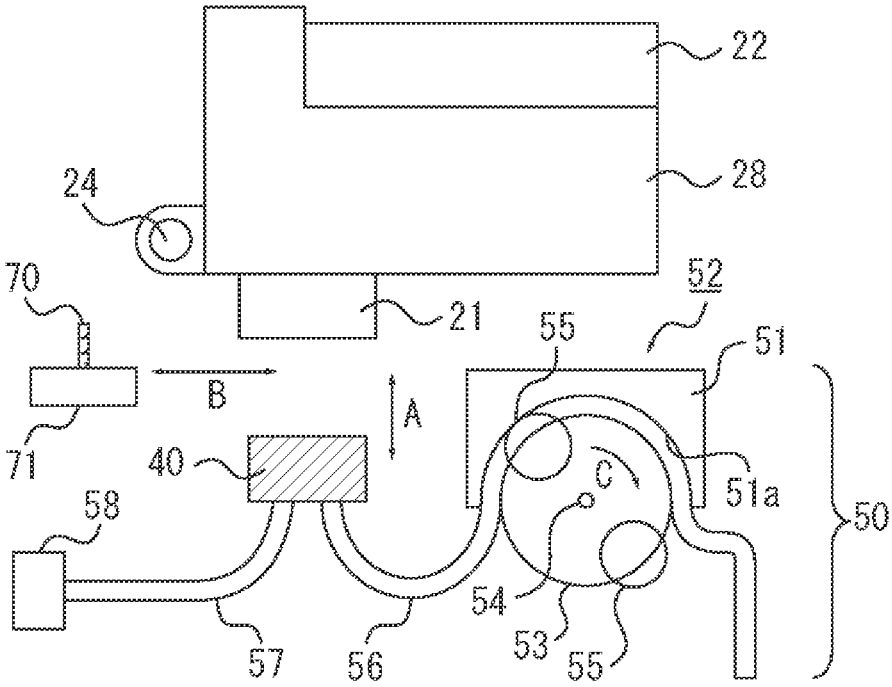
FIG. 11 is a schematic diagram illustrating a configuration example of a recovery system of an inkjet recording apparatus.

FIG. 11 is a schematic diagram illustrating a configuration example of the recovery system 50 in the inkjet printer illustrated in FIG. 10. In FIG. 11, a bearing 24 of the carriage 20 engages with the scanning rail 33. A cap 40 is capable of capping by covering a discharge port face of the recording head and can move in an arrow A direction. When the carriage 20 is located on the recovery system provided at a home position, an elevating mechanism (not illustrated) raises the cap to closely attach to the discharge port face and lowers the cap to detach the cap therefrom.

In FIG. 11, a suction tube 56 and an air communication tube 57 are in communication with the cap, and an air communication valve mechanism 58 is in communication with the air communication tube 57. This air communication valve can open and close by a not-illustrated cam mechanism.

A suction pump 52 forms a tube pump. A pump base 51 has a tube guide 51*a* which is formed on an inner side in a semi-circular shape. A roller holder 53 is provided with two rollers 55. These rollers 55 squeezes the suction tube 56 when they move along with rotation of the roller holder 53 around a rotation center 54. Accordingly, negative pressure is generated in the cap 40.

A blade holder 71 holds a blade 70. When the cap 40 has moved down and is in a standby state, by sliding the blade holder 71 in an arrow B direction, the blade 70 wipes contaminants such as ink droplets or paper dust remaining on the discharge port face while abutting the discharge port face.

Figure 12:
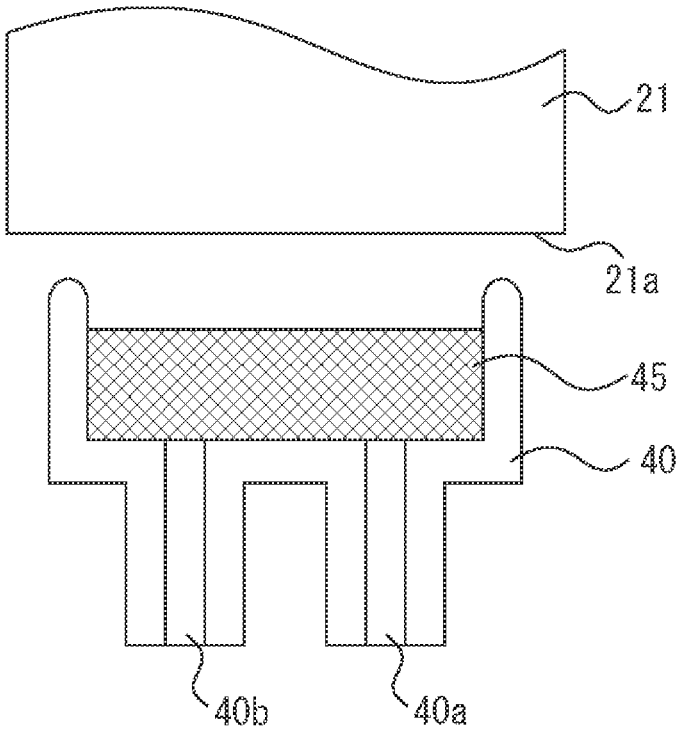
FIG. 12 is an expanded cross-sectional diagram of a cap portion of an inkjet recording apparatus.

FIG. 12 is an expanded cross-sectional diagram of a cap portion for illustrating the configuration of the cap 40. The cap 40 includes a communication port 40*a* for suction. The communication port 40*a* is in communication with the suction tube 56 illustrated in FIG. 11. Further, a communication port 40*b* for air communication is in communication with the air communication tube 57 illustrated in FIG. 11. A porous absorber 45 is provided in an interior of the cap 40. The cap 40 is closely attached to a discharge port face 21*a* so as to cap and cover with a single cap an array of the three-color discharge port illustrated in FIG. 15.

In the present exemplary embodiment, the nozzle configuration of the recording head H1001 is not limited to the configuration illustrated in FIG. 15. A nozzle array corresponding to a plurality of colors may be arranged in a straight line, or the nozzle array order for each color may be switched.

Figure 16:
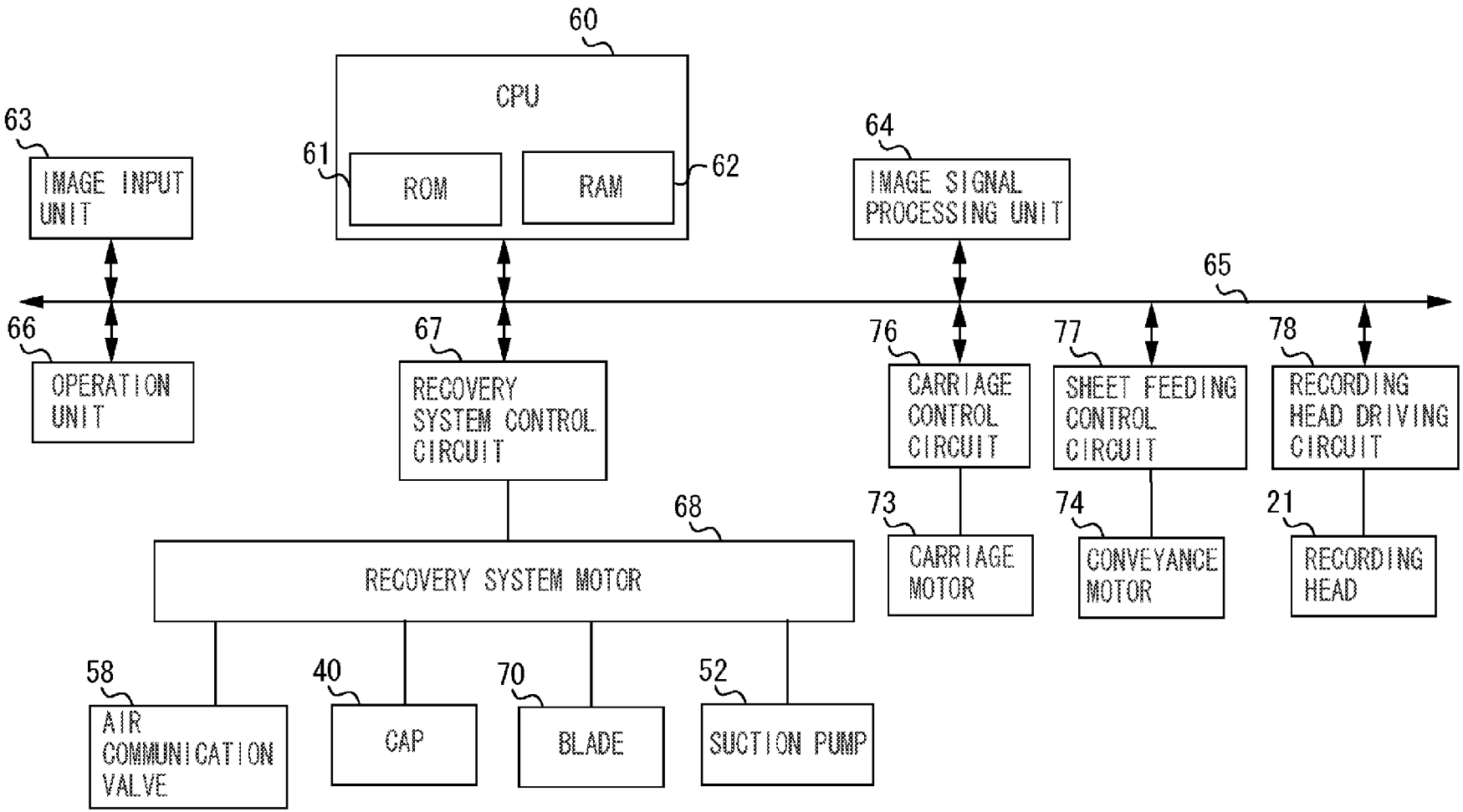
FIG. 16 is a block diagram illustrating a configuration example of an inkjet type recording apparatus to which the present invention can be applied.

FIG. 16 is a block diagram illustrating a configuration example of an inkjet type recording apparatus to which the present invention can be applied. In FIG. 16, the inkjet type recording apparatus includes an image input unit 63, an image signal processing unit 64 associated with the image input unit 63, and a central processing unit (CPU) 60 which serve as software processing units, and an operation unit 66, a recovery system control circuit 67, a carriage control circuit 76, a sheet feeding control circuit 77, and a recording head driving control circuit 78, which serve as hardware processing units. Each of these units and circuits is accessibly connected to a main bas line 65.

The CPU 60 includes a read only memory (ROM) 61 which stores a control program and a random access memory (RAM) 62 which stores various pieces of data such as print data to be supplied to a recording head 21. The CPU 60 transmits an appropriate recording condition corresponding to input information to the carriage control circuit 76, the sheet feeding control circuit 77, and the recording head driving control circuit 78 to respectively drive a carriage motor 73, a conveyance motor 74, and the recording head 21 to perform recording. The ROM 61 also stores a program for executing a timing chart for recovery processing, which will be described below, and the CPU 60 transmits a control condition to the recovery system control circuit 67 and the recording head driving control circuit 78 and executes the recovery processing, if necessary (for example, when an execution instruction for suction recovery processing is issued from the operation unit 66.)

The recovery system control circuit 67 drives the recovery system motor 68 so as to operate the cap 40, the air communication valve 58, the blade 70, and the suction pump 52 by a not-illustrated cam mechanism. The recording head control circuit 78 drives an electrothermal converter in the recording head H1001 for ink discharge during recording and for preliminary discharge. Consequently, the recovery operation described below can be executed.

In the present exemplary embodiment, an operation for opening the air communication valve while the cap was fitted is performed after temporarily stopping the pump. However, the present invention is not limited to this procedure. The operation for opening the air communication valve may also be performed while a pump suction operation is performed.

Further, although the present exemplary embodiment described a configuration with one cap, the present invention may also be applied in a suction operation using a plurality of caps. In such a case, the suction operation may be performed by each of the plurality of caps, or by just one of the plurality of caps.

In addition, although the pump configuration is described as a tube pump, the present invention is not limited to the tube pump. The pump may have any configuration, as long as a negative pressure can be generated in the cap.

Accordingly, the inkjet recording apparatus according to the present invention includes a cap unit, and a recovery unit for performing a recovery operation on the recording head so that the ink is stably discharged from the discharge port.

Figure 1:
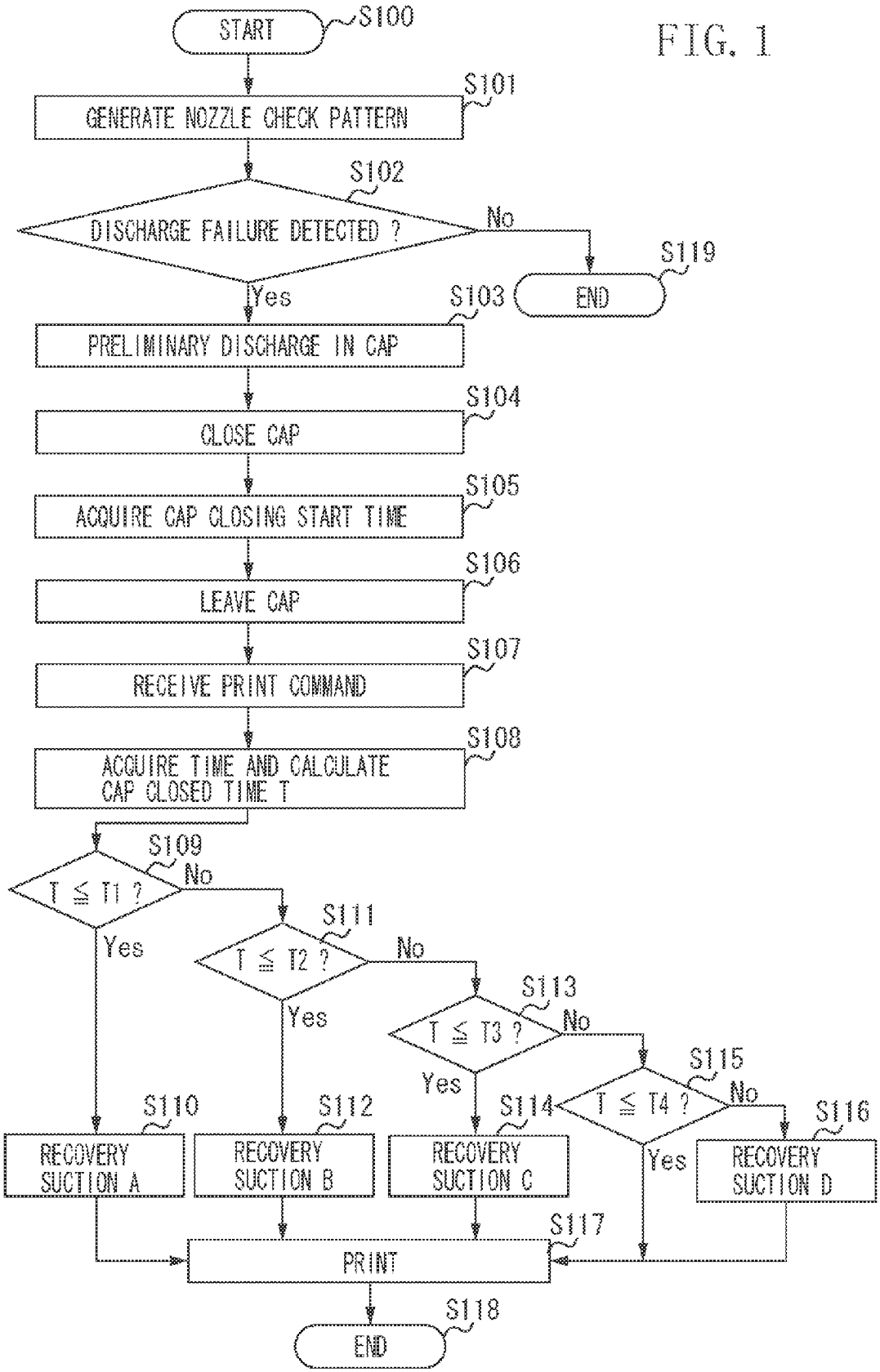
FIG. 1 is a flowchart illustrating a sequence.

The sequence of the present exemplary embodiment will be described based on the flowchart illustrated in FIG. 1. First, in step S100, the sequence is started by a power input or the like. Then, in step S101, a nozzle check pattern is printed to detect a discharge failure level. In step S102, based on the printed nozzle check pattern, presence of discharge failure is detected. If there is no discharge failure in the detection results ("NO" in step S102), the processing proceeds to step S119. In step S119, the sequence is finished, and the processing waits for a print command (recording operation command).

At this stage, in the step for detecting the discharge failure level, the inkjet recording apparatus itself may automatically read the printed nozzle check pattern to detect the discharge failure level. Further, from a perspective of reducing costs, a user may read the printed nozzle check pattern to determine the presence of discharge failure, and input the result.

If there is a discharge failure in the detection results ("YES" in step S102), in step S103, a preliminary discharge is performed on the porous absorber 45 in the cap. Then, in step S104, the cap is closed.

By thus producing a state where the ink is present in the cap as a liquid, the discharge port face can be kept moist. At this point, in step S105, time is acquired from an external apparatus, and stored in a storage memory.

Examples of the main external apparatuses which are connected to the inkjet recording apparatus include a personal computer and a digital camera as a host computer for sending recorded data to the inkjet recording apparatus. These external apparatuses have a clock function, and the user can set the clock. Time information may be acquired by utilizing the clock function of the external apparatus, or by measuring from a clock device that the recording apparatus itself has.

Next, in step S106, the discharge port face is left in a moistened cap closed state (cap leaving). In step S107, a print command is input by the user. The print command may be input immediately after the cap leaving, or input after the cap was left for long period of time.

After the print command is input in step S107, in step S108, the current time is acquired by the method described above. An elapsed time T of the cap closed state after the discharge failure level detection is calculated based on the time information and the time stored in the storage memory in step S105.

In step S109, if this elapsed time T of the cap closed state is equal to or less than T1 ("YES" in step S109), in step S110, recovery suction A is performed. In the present exemplary embodiment, time T1 is 2 hours, and an ink suction amount in the recovery suction A is 0.30 g.

When the elapsed time T of the cap closed state is comparatively short, sufficient recovery due to the moistening is not achieved. Thus, the recording head is recovered from the discharge failure before printing (before the recording operation) by performing the recovery suction A, which is comparatively stronger than below-described recovery suction B and recovery suction C. Subsequently, in step S117, printing is performed. Then in step S118, the sequence is finished.

Similarly, in step S111, if the elapsed time T of the cap closed state is $T1<T\leq T2$ ("YES" in step S111), in step S112, the recovery suction B is performed. In the present exemplary embodiment, time T2 is 4 hours, and the ink suction amount in the recovery suction B is 0.15 g.

When the elapsed time T of the cap closed state is more than 2 hours to 4 hours or less, although recovery due to the moistening is achieved to a certain extent, it is not sufficient. Thus, while suction as strong as the recovery suction A is not required, recovery from the discharge failure is achieved by performing the recovery suction B. The recovery suction B has strength between that of the above-described recovery suction A and the below-described recovery suction C. Subsequently, in step S117, printing is performed, and in step S118, the sequence is finished.

In step S113, if the elapsed time T of the cap closed state is $T2<T\leq T3$ ("YES" in step S113), in step S114, the recovery suction C is performed. In the present exemplary embodiment, time T3 is 6 hours, and the ink suction amount in the recovery suction C is 0.10 g.

When the elapsed time T of the cap closed state is more than 4 hours to 6 hours or less, although recovery due to the moistening is basically achieved, it is still not sufficient. Thus, while suction as strong as the above-described recovery suction A or recovery suction B is not required, recovery from the discharge failure is achieved by performing the weak recovery suction C. Subsequently, in step S117, printing is performed, and in step S118, the sequence is finished.

In step S115, if the elapsed time T of the cap closed state is $T3<T\leq T4$ ("YES" in step S115), suction is not performed. In the present exemplary embodiment, time T4 is 60 days.

When the elapsed time T of the cap closed state is more than a first time (in the present exemplary embodiment, 6 hours) but equal to or less than a second time (in the present exemplary embodiment, 60 days), suction is not required, as recovery due to the moistening is achieved. Therefore, in step S117, printing is performed without performing suction, and in step S118, the sequence is finished.

In step S115, if the elapsed time T of the cap closed state is greater than T4 ("NO" in step S115), in step S116, recovery suction D is performed. As described above, time T4 is 60 days, and the ink suction amount in the recovery suction D is 0.05 g. Although there is a slight amount of moisture in the cap, the moisture gradually evaporates.

Thus, when the elapsed time T of the cap closed state is more than the second time (in the present exemplary embodiment, 60 days), although recovery due to moistening is once achieved, drying of the discharge port gradually progresses due to the dryness in the cap. Consequently, recovery from the discharge failure is achieved by performing the recovery suction D. Subsequently, in step S117, printing is performed, and in step S118, the sequence is finished.

As described above, in the present exemplary embodiment, until the elapsed time T4, control is performed so that the ink amount to be discarded by the suction operation performed before printing (before the recording operation) is reduced the longer the elapsed time T of the cap closed state after discharge failure level detection is. Therefore, in addition to a when recovery is achieved by moistening recovery, when a print command is input before recovery by the moistening recovery, the suction amount is controlled with consideration given to a recovery level according to the moistening time. Consequently, the amount of discarded ink can be reduced compared with conventional ink suction recovery.

In a second exemplary embodiment, until the elapsed time T reaches a predetermined time, if the elapsed time T is the same, the ink amount to be discarded by the suction recovery operation which is performed before printing is controlled so as to decrease the better the discharge failure level detected by a discharge failure detection unit is. Other than this feature, the present exemplary embodiment is similar to the first exemplary embodiment. The second exemplary embodiment will be described in more detail using FIGS. 2 to 5.

Figure 2:
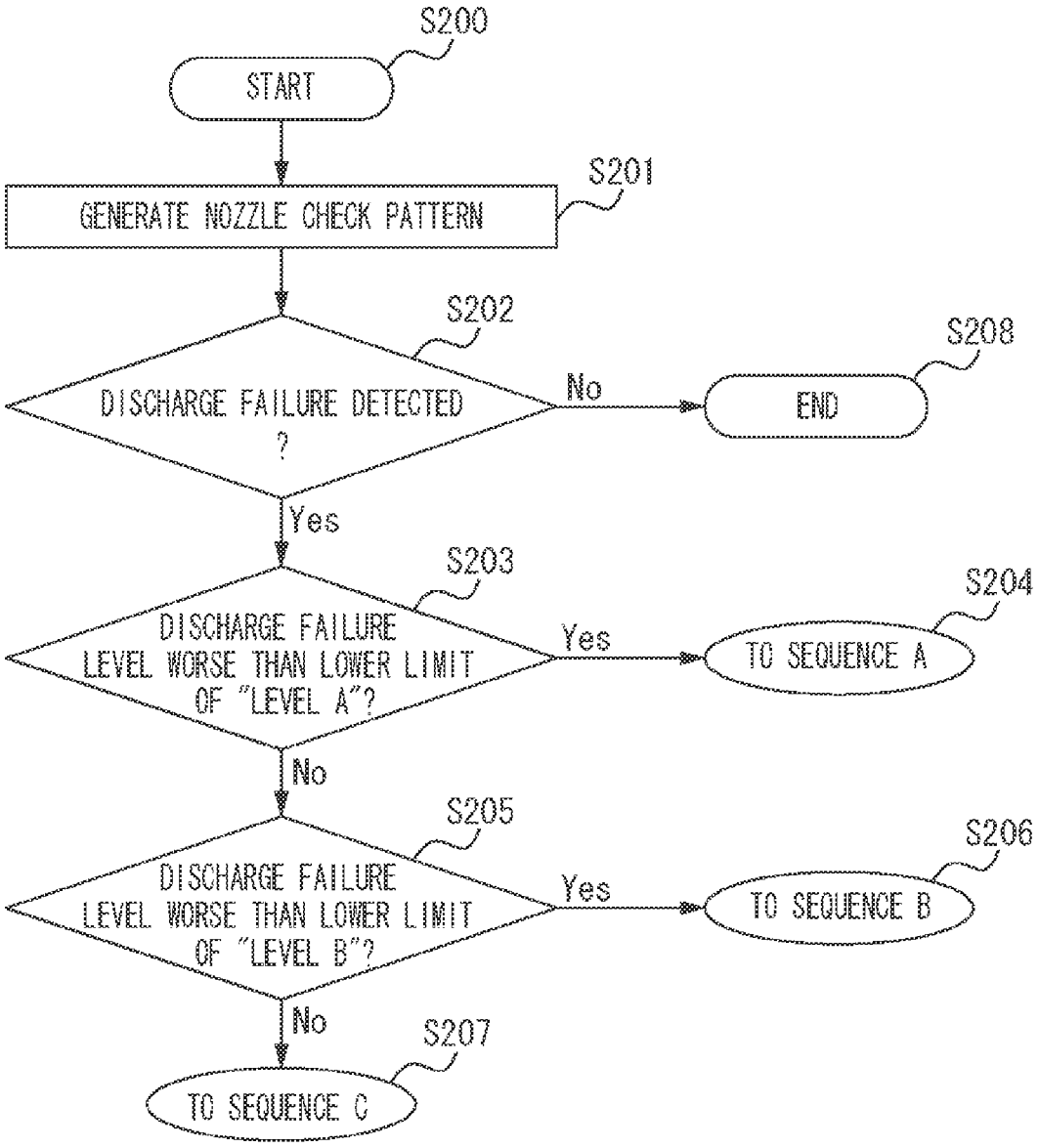
FIG. 2 is a flowchart illustrating a second exemplary embodiment.

FIG. 2 illustrates a flowchart of the present exemplary embodiment. Similar to the first exemplary embodiment, in step S200, the sequence is started by a power input or the like. Then, in step S201, a nozzle check pattern is printed to detect the discharge failure level.

In the present exemplary embodiment, based on the printed nozzle check pattern, in addition to the presence of discharge failure, the detected discharge failure level is specified from among a plurality of predetermined discharge failure levels. The present exemplary embodiment will be described using four printing state levels of, going from bad to good, level A, level B, level C, and level D (good).

First, in step S202, the presence of discharge failure is detected. If there is no discharge failure ("NO" in step S202), it is determined that the discharge failure level is level D (good), and the processing proceeds to step S208. In step S208, the sequence is finished, and the processing waits for a print command.

If there is a discharge failure ("YES" in step S202), the processing proceeds to step S203. In step S203, it is detected whether the discharge failure level is worse than the lower limit of "level A". If the discharge failure level is worse than the lower limit of "level A" ("YES" in step S203), the discharge failure level is set as the level A, and the processing proceeds to step S204. In step S204, a below-described "sequence A" corresponding to the discharge failure level A is started.

If the discharge failure level is better than the lower limit of "level A" ("NO" in step S203), then in step S205, it is detected whether the discharge failure level is worse than the lower limit of "level B". If the discharge failure level is worse than the lower limit of "level B" ("YES" in step S205), the discharge failure level is set as level B, and the processing proceeds to step S206. In step S206, a below-described "sequence B" corresponding to the discharge failure level B is started.

If the discharge failure level is better than the lower limit of "level B" ("NO" in step S205), the discharge failure level is set as level C, and the processing proceeds to step S207. In step S207, a below-described "sequence C" corresponding to the discharge failure level C is started. Thus, the discharge failure level is classified into multiple levels, and a sequence corresponding to those levels is performed. Each of these level sequences will be described in more detail.

Figure 3:
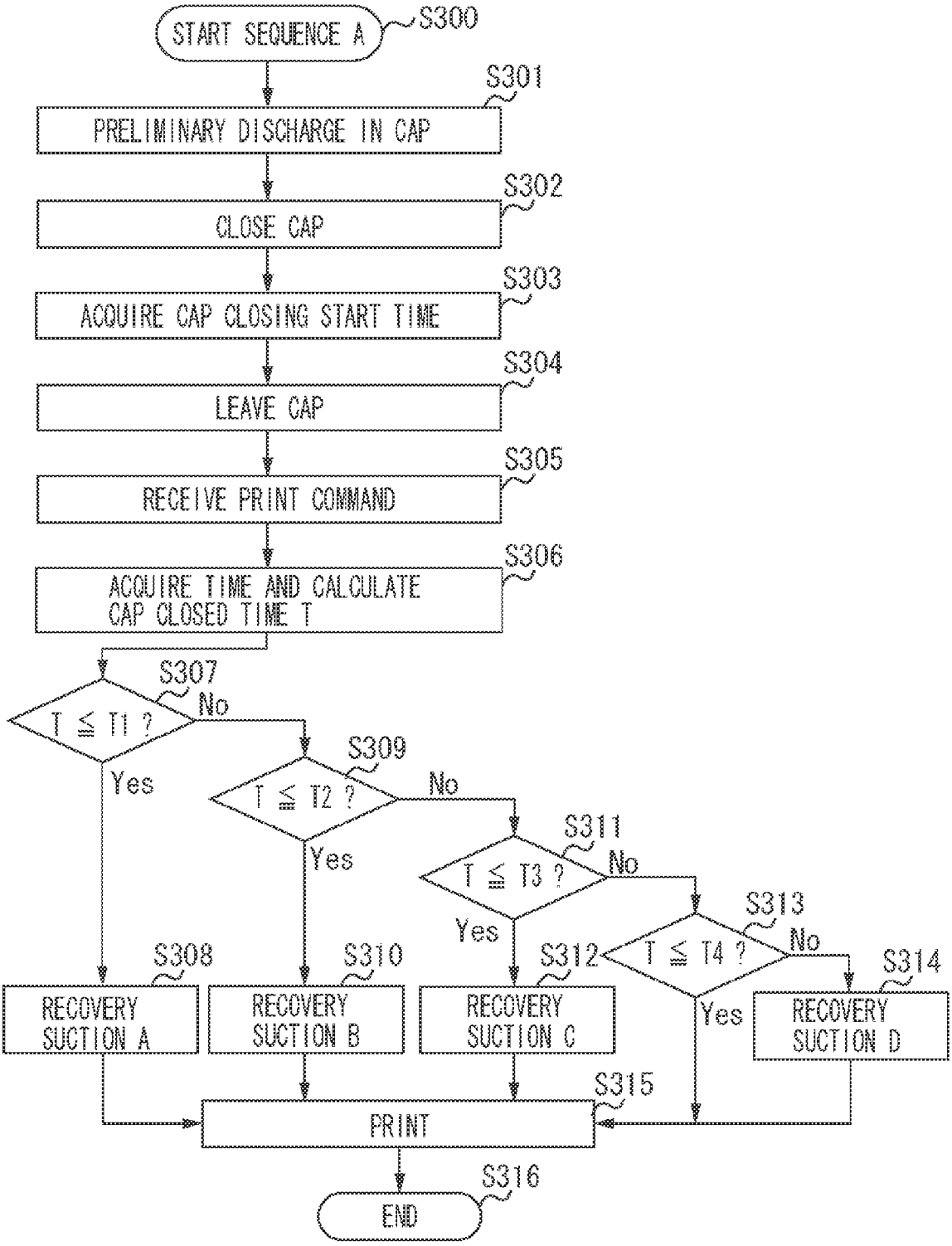
FIG. 3 is a flowchart illustrating a "sequence A" of the second exemplary embodiment.

FIG. 3 is a flowchart illustrating "sequence A", corresponding to "level A" which is the worst discharge failure level.

In step S300, the discharge failure level is detected as the level A, and the sequence A is started. Then, in step S301, a preliminary discharge is performed on the porous absorber 45 in the cap.

Subsequently, in step S302, the cap is closed. By thus moistening the inside of the cap, the discharge port face can be left in a moist state. At this point, similar to the first exemplary embodiment, in step S303, the time is acquired from an external apparatus, and stored in the storage memory. Next, in step S304, the discharge port face is left in a moistened cap closed state (cap leaving).

Subsequently, in step S305, a print command is input by a user. In step S306, the current time is acquired, and then the elapsed time T of the cap closed state after the discharge failure level detection is calculated based on the time information and the time stored in the storage memory in step S303. Similar to the first exemplary embodiment, time T1 is 2 hours, time T2 is 4 hours, time T3 is 6 hours, and time T4 is 60 days, and the suction strength is set as recovery suction A>recovery suction B>recovery suction C.

In step S307, if the elapsed time T of the cap closed state is equal to or less than T1 ("YES" in step S307), in step S308, the recovery suction A is performed. When the elapsed time T of the cap closed state is a comparatively short 2 hours or less, sufficient recovery due to the moistening is not achieved. Thus, the recovery from the discharge failure is achieved by performing the comparatively strong recovery suction A. Subsequently, in step S315, printing is performed, and in step S316, the sequence is finished.

In step S309, if the elapsed time T of the cap closed state is T1<T≤T2 ("YES" in step S309), in step S310, the recovery suction B is performed. When the elapsed time T of the cap closed state is more than 2 hours to 4 hours or less, although recovery due to the moistening is achieved to a certain extent, it is not sufficient. Thus, the recovery from the discharge failure is achieved by performing the recovery suction B, which is of a medium level. Subsequently, in step S315, printing is performed, and in step S316, the sequence is finished.

In step S311, if the elapsed time T of the cap closed state is T2<T≤T3 ("YES" in step S311), in step S312, the recovery suction C is performed. When the elapsed time T of the cap closed state is more than 4 hours to 6 hours or less, although recovery due to the moistening is basically achieved, it is still not sufficient. Thus, the recovery from the discharge failure is achieved by performing the weak recovery suction C. Subsequently, in step S315, printing is performed, and in step S316, the sequence is finished.

In step S313, if the elapsed time T of the cap closed state is T3<T≤T4 ("YES" in step S313), suction is not performed, as recovery due to the moistening is achieved. Subsequently, in step S315, printing is performed, and in step S316, the sequence is finished.

In step S313, if the elapsed time T of the cap closed state is greater than T4 ("NO" in step S313), in step S314, the recovery suction D is performed. Although there is a slight amount of moisture in the cap, this moisture gradually evaporates. Therefore, when the elapsed time T of the cap closed state is more than 60 days, although recovery due to moistening is once achieved, drying of the discharge port gradually progresses due to the dryness in the cap. Consequently, the recovery from the discharge failure is achieved by performing the recovery suction D. Subsequently, in step S315, printing is performed, and in step S316, the sequence is finished.

Figure 4:
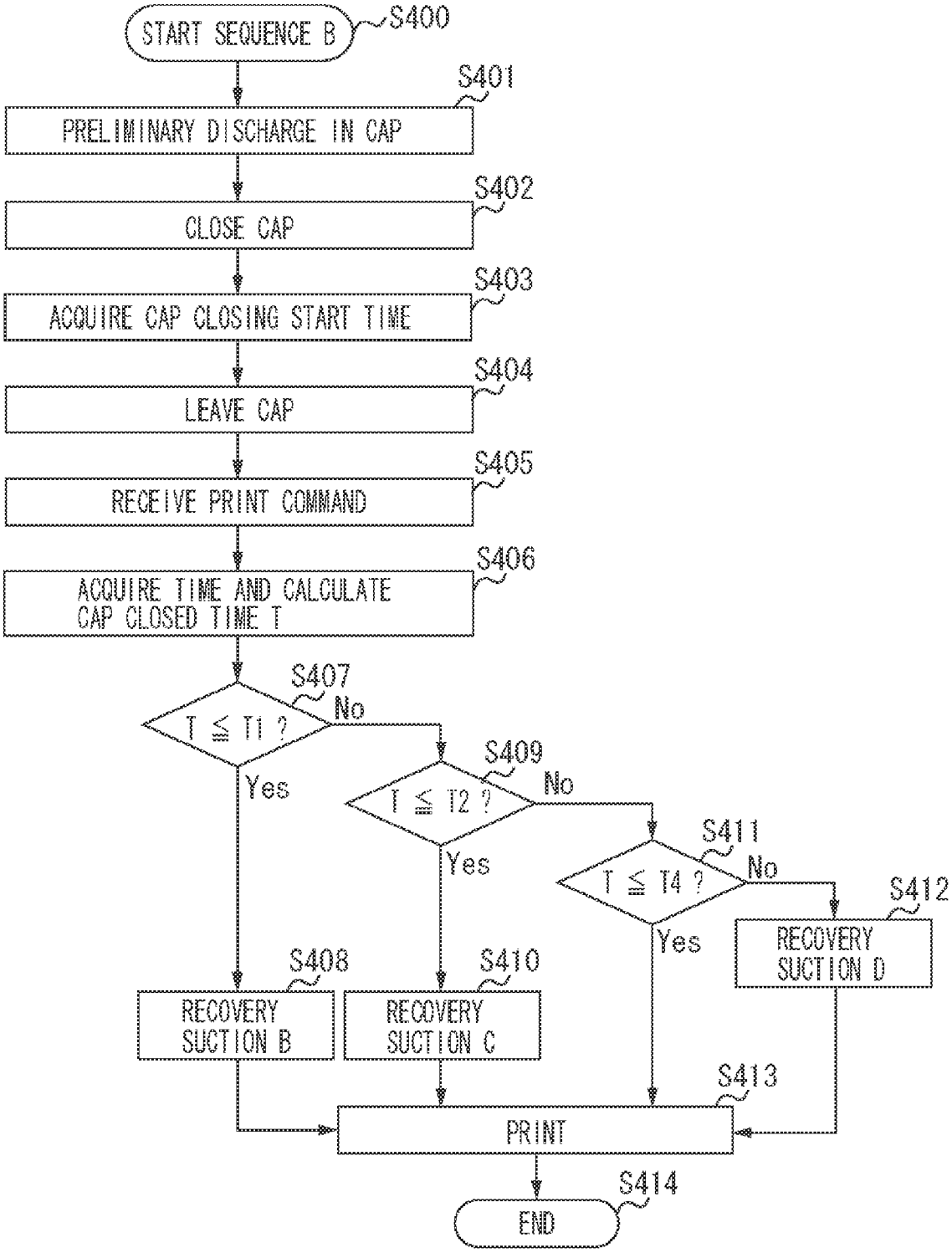
FIG. 4 is a flowchart illustrating a "sequence B" of the second exemplary embodiment.

FIG. 4 is a flowchart illustrating "sequence B" corresponding to "level B", which is a better discharge failure level than "level A".

In step S400, the discharge failure level is detected as the level B, and the sequence B is started. Then, similar to the above-described sequence A, in step S401, a preliminary discharge is performed on the porous absorber 45 in the cap.

Subsequently, in step S402, the cap is closed. In step S403, the time is acquired from an external apparatus, and stored in the storage memory. In step S404, the discharge port face is left in a moistened cap closed state (cap leaving).

Subsequently, in step S405, a print command is input by the user. In step S406, the current time is acquired by a method such as that described above, and then the elapsed time T of the cap closed state after the discharge failure level detection is calculated based on the time information and the time stored in the storage memory in step S403.

As described above, the level in which the "sequence B" is applied is the "discharge failure level B" which is a better discharge failure level than the level A during the discharge failure detection before closing the cap. Therefore, in step S407, if the elapsed time T of the cap closed state is equal to or less than T1 ("YES" in step S407), the processing proceeds to step S408. In step S408, the recovery from the discharge failure is achieved by performing the recovery suction B which is weaker than the recovery suction A performed in the sequence A for the same time T. Subsequently, in step S413, printing is performed, and in step S414, the sequence is finished.

Similarly, in step S409, if the elapsed time T of the cap closed state is T1<T≤T2 ("YES" in step S409), the processing proceeds to step S410. In step S410, recovery from the discharge failure is achieved by performing the recovery suction C which is weaker than the recovery suction B performed in the sequence B for the same time T. If the elapsed time T is T2<T≤T4 ("YES" in step S411), suction is not performed. Subsequently, in step S413, printing is performed, and in step S414, the sequence is finished.

Thus, during the discharge failure detection before closing the cap, if the discharge failure level is the level B, when the elapsed time T is more than 4 hours (to 60 days or less), suction is not required as recovery due to the moistening is achieved.

When the elapsed time T of the cap closed state is greater than T4, similarly to the sequence A, the recovery suction D is performed. Subsequently, in step S413, printing is performed, and in step S414, the sequence is finished.

Figure 5:
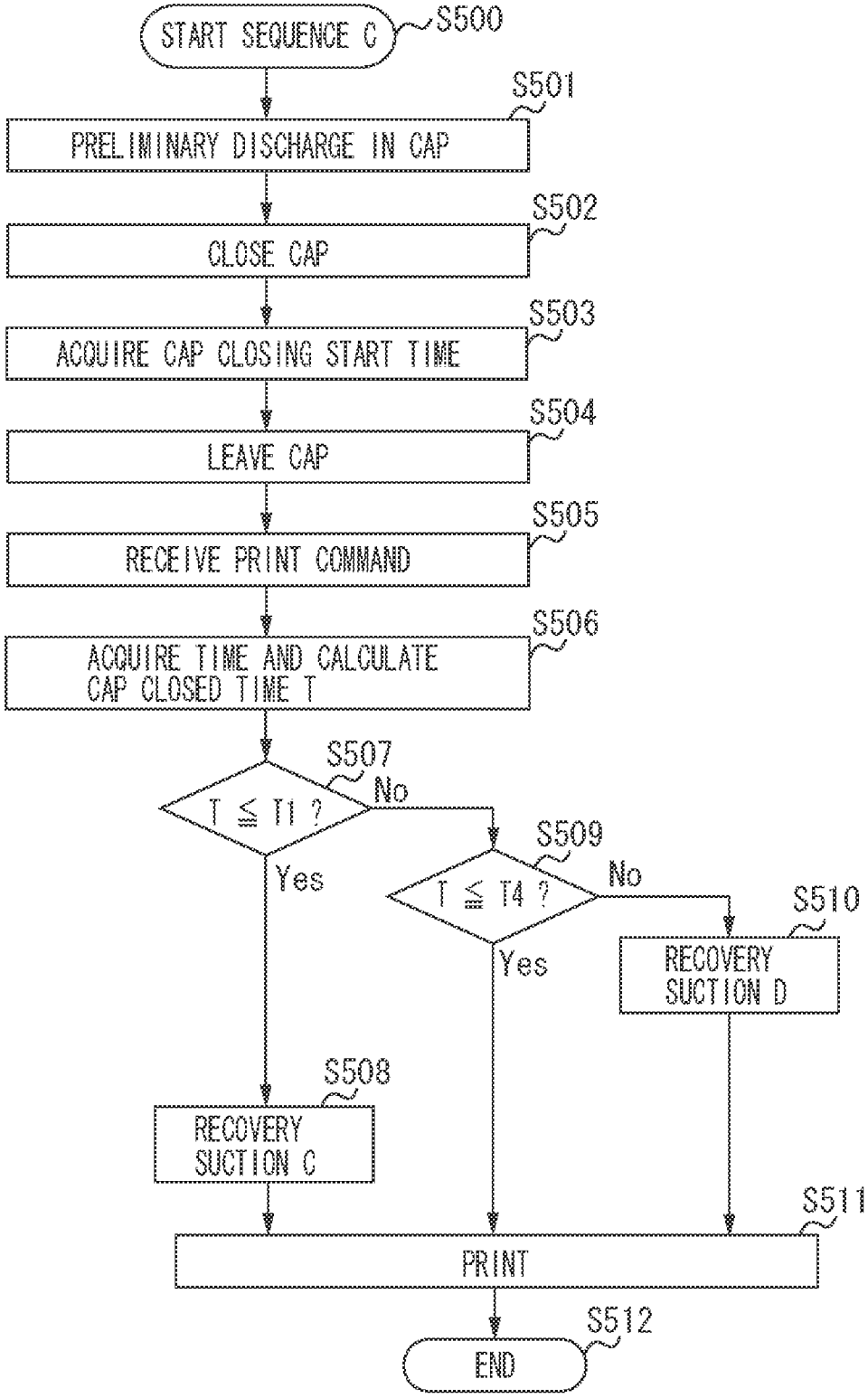
FIG. 5 is a flowchart illustrating a "sequence C" of the second exemplary embodiment.

FIG. 5 is a flowchart illustrating "sequence C" corresponding to "level C", which is an even better discharge failure level than "level B".

In step S500, the discharge failure level is detected as the level C, and the sequence C is started. Then, similar to the above-described sequences A and B, in step S501, a preliminary discharge is performed on the porous absorber 45 in the cap.

Subsequently, in step S502, the cap is closed. In step S503, the time is acquired from an external apparatus, and stored in the storage memory. In step S504, the discharge port face is left in a moistened cap closed state (cap leaving).

Subsequently, in step S505, a print command is input by the user. In step S506, the current time is acquired, and then the elapsed time T of the cap closed state after the discharge failure level detection is calculated based on the time information and the time stored in the storage memory in step S503.

As described above, the level in which the "sequence C" is applied is "discharge failure level C" which is an even better discharge failure level than the level B during the discharge failure detection before closing the cap. Therefore, in step S507, if the elapsed time T of the cap closed state is equal to or less than T1 ("YES" in step S507), the processing proceeds to step S508. In step S508, the recovery from the discharge failure is achieved by performing the recovery suction C which is even weaker than the recovery suction B performed in the sequence B for the same time T.

Similarly, as illustrated in step S411, in step S509, if the elapsed time T of the cap closed state is T1<T≤T4 ("YES" in step S509), printing is performed without carrying out suction.

During the discharge failure detection before closing the cap, if the discharge failure level is the level C, when the elapsed time T is more than 2 hours (to 60 days or less), suction is not required as recovery due to the moistening is achieved.

When the elapsed time T of the cap closed state is greater than T4 ("NO" in step S509), in step S510, the recovery suction D is performed. Subsequently, in step S511, printing is performed, and in step S512, the sequence is finished.

FIG. 6 is a table illustrating a "relationship between elapsed time T in a cap closed state and recovery suction" of the above sequences. In the present exemplary embodiment, until the predetermined time T4, if the elapsed time T is the same, control is performed so as to reduce the ink amount to be discarded by the suction recovery operation performed before printing the better the discharge failure level detected by the discharge failure detection unit is.

Accordingly, in the present exemplary embodiment, even if a print command is input before completion of recovery during moistening recovery, the suction amount is controlled while consideration is given to a recovery level according to the moistening time. Further, since the suction amount control is performed based on the discharge failure level of before the recovery processing, the amount of discarded ink can be substantially reduced even more than in conventional ink suction recovery.

Figure 7:
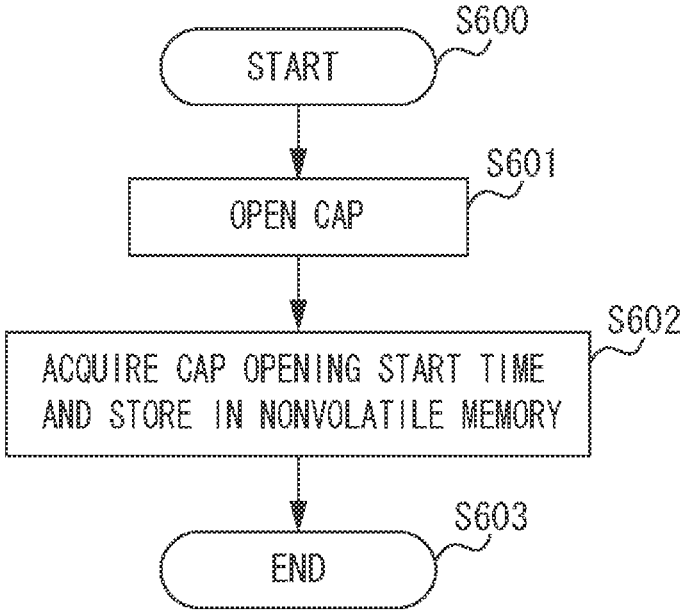
FIG. 7 is a flowchart illustrating a third exemplary embodiment.

Next, another exemplary embodiment of a discharge failure detection unit will be described. In a third exemplary embodiment, a discharge failure level is detected based on cap open state time during which the cap is separated from the discharge port face. The specific sequence will be described using FIGS. 7 and 8.

The inkjet recording apparatus according to the present exemplary embodiment includes a non-volatile memory. In step S600, the sequence is started when a cap open operation command is received during a cap closed state in which the cap abuts the discharge port face. In step S601, the cap is opened. Then, in step S602, the current time is acquired by a method such as that described above, and the time information is stored in the non-volatile memory as a cap open start time.

The non-volatile memory can continue to keep stored information even when the power of the inkjet recording apparatus is turned off. Then, in step S603, this sequence is finished.

Figure 8:
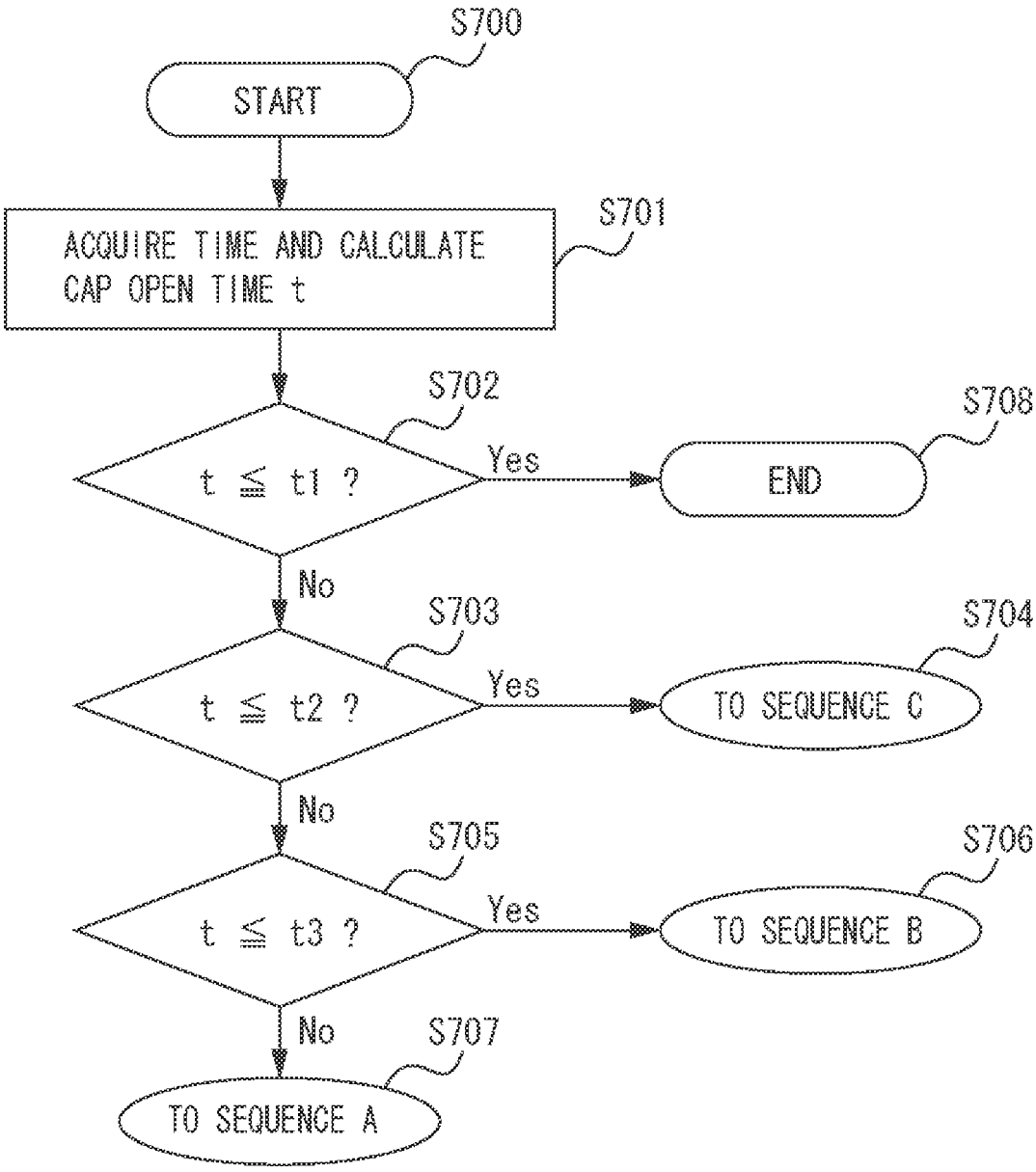
FIG. 8 is a flowchart illustrating the third exemplary embodiment.

FIG. 8 is a sequence which is performed when the apparatus power is turned off during printing, or in a state where the recording head has not completely undergone cap closure. In the present exemplary embodiment, below-described time t1 is 1 week, time t2 is 2 weeks, and time t3 is 1 month.

In step S700, this sequence is started. In step S701, the current time is acquired by a method such as that described above, and a cap open time t is calculated based on the time information and the time stored in the non-volatile memory in step S602.

In step S702, if the cap open time t is equal to or less than t1 ("YES" in step S702), the discharge failure level is detected as the level D (good), and in step S708, the sequence is finished.

In step S703, if the cap open time t is $t1<t\leq t2$ ("YES" in step S703), in step S704, the discharge failure level is detected as the level C. In this case, "sequence C" corresponding to the discharge failure level C in the second exemplary embodiment is started.

In step S705, if the cap open time t is $t2<t\leq t3$ ("YES" in step S705), in step S706, the discharge failure level is detected as the level B. Similarly, "sequence B" corresponding to the discharge failure level B in the second exemplary embodiment is started.

If the cap open time t is greater than t3 ("NO" in step S705), in step S707, the discharge failure level is detected as the level A. Similarly, "sequence A" corresponding to the discharge failure level A in the second exemplary embodiment is started.

Thus, the recovery sequence may also be performed based on the discharge failure level which is detected based on the cap open state time during which the cap is separated from the discharge port face.

Figure 9:
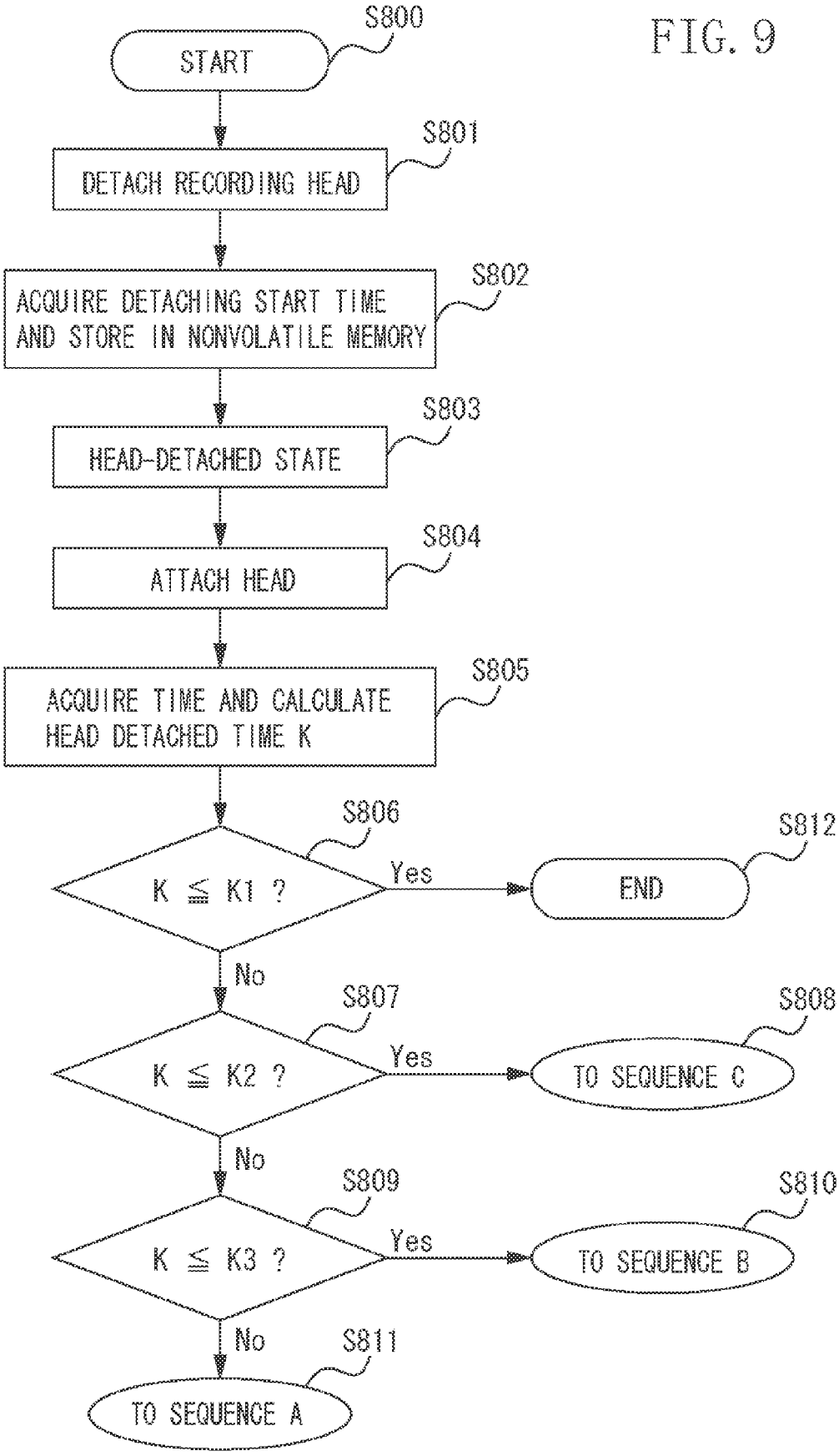
FIG. 9 is a flowchart illustrating a fourth exemplary embodiment.

Next, yet another exemplary embodiment of a discharge failure detection unit will be described. In a fourth exemplary embodiment, the discharge failure level is detected based on how long the recording head was detached from the inkjet recording apparatus. The specific sequence will be described using FIG. 9.

In step S800, the sequence is started. In step S801, the recording head is detached from the inkjet recording apparatus. Then, in step S802, the current time is acquired by a method such as that described above, and the time information is stored in a memory as a detaching start time.

In step S803, the recording head is in a head-detached state. Subsequently, in step S804, the head is attached. Once the head is attached, in step S805, the current time is acquired by a method such as that described above, and a head detached time K is calculated based on the time information and the detaching start time stored in the memory.

In the present exemplary embodiment, time K1 is 1 week, time K2 is 2 weeks, and time K3 is 1 month. In step S806, if the head detached time K is equal to or less than K1 ("YES" in step S806), the discharge failure level is detected as the level D (good), and in step S812, the sequence is finished.

In step S807, if the head detached time K is $K1<K\leq K2$ ("YES" in step S807), in step S808, the discharge failure level is detected as the level C. Similar to the second exemplary embodiment, "sequence C" corresponding to the discharge failure level C is started.

In step S809, if the head detached time K is $K2<K\leq K3$ ("YES" in step S809), in step S810, the discharge failure level is detected as the level B. Similar to the second exemplary embodiment, "sequence B" corresponding to the discharge failure level B is started.

In step S809, if the head detached time K is greater than K3, ("NO" in step S809), then in step S811, the discharge failure level is detected as the level A. Similar to the second exemplary embodiment, "sequence A" corresponding to the discharge failure level A is started.

Thus, the recovery sequence may also be performed based on the discharge failure level which is detected based on how long the recording head was detached from the inkjet recording apparatus.

A fifth exemplary embodiment is characterized by constantly performing a preliminary discharge in the cap when the cap is closed, without detecting discharge failure in a nozzle check pattern or the like. Consequently, regardless of the presence of discharge failure, when the discharge port face is capped and left, the interior of the cap is constantly kept moist. Other than this feature, the processing similar to that in the first exemplary embodiment is performed. Therefore, the processing of steps S101, S103, and S119 in FIG. 1 are omitted. After the sequence has started, the processing is controlled to perform discharge into the cap in step S103.

Thus, since in the present exemplary embodiment a moist state is kept regardless of the discharge port failure, in addition to the effects of the first exemplary embodiment, occurrence of discharge failure can be suppressed by constantly keeping the discharge port moist.

In the above exemplary embodiments, after the ink is discharged into the cap, the cap is closed. The elapsed time for controlling the suction amount is calculated based on the cap close time. The exemplary embodiments of the present invention provides the effect of using less ink by controlling the suction amount based on the capping time in a state where ink is present in the cap. Therefore, if the time for discharging ink in the cap and the cap close time are close, either discharging ink into the cap or cap closing may be performed first. Further, in such a case, measurement of the elapsed time may be started from either time.

Further, the exemplary embodiments of the present invention close the cap in a state where the ink is present in the cap. The method for discharging the ink into the cap is not limited to discharging from the recording head. For example, a flow path or the like capable of directly supplying the ink into the cap from the ink tank may be provided.

In the above exemplary embodiments, a nozzle check pattern is printed. When a discharge failure nozzle is detected from the detection result of the nozzle check pattern, ink is discharged into the cap and the cap is then closed. In the exemplary embodiments of the present invention, it is not essential to detect discharge failure. More specifically, discharging the ink into the cap and then closing the cap is not limited to cases where discharge failure is detected.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-304602 filed Nov. 28, 2008 and No. 2009-246668 filed Oct. 27, 2009, which are hereby incorporated by reference herein in their entirety.

What is claimed is:

1. An inkjet recording apparatus comprising:

a recording head that includes a discharge port face on which a plurality of discharge ports for discharging ink are formed;

a cap configured to cap the discharge port face;

a moistening unit configured to moisturize the recording head by causing the cap to cap the discharge port face with the ink being remained within the cap;

a suction unit configured to perform a suction operation to suck ink from the recording head via the cap; and a control unit configured to control a driving amount of the suction unit in a manner such that a driving amount by which the suction unit is driven when the moistening time is longer than a predetermined time is smaller than a driving amount by which the suction unit is driven when the moistening time is shorter than the predetermined time.

2. The inkjet recording apparatus according to claim 1, wherein the control unit causes the suction unit not to perform the suction operation in a case where the moistening time is longer than a first predetermined time.

3. The inkjet recording apparatus according to claim 2, wherein the control unit causes the suction unit to perform the suction operation in a case where the moistening time is longer than a second predetermined time which is longer than the first predetermined time.

4. The inkjet recording apparatus according to claim 1, further comprising:

a detection unit configured to detect discharge failure of the plurality of discharge ports, wherein the control unit controls the driving amount of the suction unit based on the moistening time and a detection result of the detection unit.

5. An inkjet recording apparatus comprising:

a recording head that includes a discharge port face on which a plurality of discharge ports for discharging ink are formed;

a cap configured to cap the discharge port face;

a moistening unit configured to moisturize the recording head by causing the cap to cap the discharge port face with the ink being remained within the cap;

a suction unit configured to perform a suction operation to suck ink from the recording head via the cap; and a control unit configured to control a suction force generated by the suction unit in a manner such that a sucking force generated by the suction unit when the moistening time is longer than a predetermined time is smaller than a sucking force generated by the suction unit when the moistening time is shorter than the predetermined time.

6. The inkjet recording apparatus according to claim 5, wherein the control unit causes the suction unit not to perform the suction operation in a case where the moistening time is longer than a first predetermined time.

7. The inkjet recording apparatus according to claim 6, wherein the control unit causes the suction unit to perform the suction operation in a case where the moistening time is longer than a second predetermined time which is longer than the first predetermined time.

8. The inkjet recording apparatus according to claim 5, further comprising:

a detection unit configured to detect discharge failure of the plurality of discharge ports, wherein the control unit controls the sucking force generated by the suction unit based on the moistening time and a detection result of the detection unit.

* * * * *